US012655784B2

(12) United States Patent
Igade et al.

(10) Patent No.: US 12,655,784 B2
(45) Date of Patent: Jun. 16, 2026

(54) EXHAUST AFTERTREATMENT SYSTEM

(71) Applicant: DAF Trucks N.V., Eindhoven (NL)

(72) Inventors: Satish Igade, Eindhoven (NL); John De Graaf, Eindhoven (NL); Guy Tillemans, Eindhoven (NL)

(73) Assignee: DAF Trucks N.V., Eindhoven (NL)

( * ) Notice: Subject to any disclaimer, the term of this patent is extended or adjusted under 35 U.S.C. 154(b) by 0 days.

(21) Appl. No.: 19/178,972

(22) Filed: Apr. 15, 2025

(65) Prior Publication Data

US 2026/0015959 A1 Jan. 15, 2026

(30) Foreign Application Priority Data

Jul. 9, 2024 (NL) ..... 2038173

(51) Int. Cl.
*F01N 3/20* (2006.01)

(52) U.S. Cl.
CPC ..... *F01N 3/208* (2013.01); *F01N 3/206* (2013.01)

(58) Field of Classification Search
CPC .... F01N 3/208; F01N 3/206; F01N 2560/026; F01N 2900/0601; F01N 2900/1806;
(Continued)

(56) References Cited

U.S. PATENT DOCUMENTS 7,930,116 B2 * 4/2011 Huebner ..... F01N 11/00 702/50
9,062,807 B2 * 6/2015 Offenhuber ..... F01N 11/00
(Continued)

FOREIGN PATENT DOCUMENTS

CA 3125388 A1 1/2022
CN 110792493 A 2/2020
(Continued)

OTHER PUBLICATIONS

Dutch Search Report and Written Opinion—App No. 2038173—mailing date Oct. 1, 2024.

*Primary Examiner* — Jesse S Bogue
(74) *Attorney, Agent, or Firm* — Banner & Witcoff, Ltd.

(57) ABSTRACT

An exhaust aftertreatment system comprises a pump; reagent dosing devices arranged in series with each other; and a controller. The controller comprises a dosing device diagnostic circuit configured to in a first stage measuring a first stage diagnostic indicating an amount of reagent dosed by all the reagent dosing devices, and comparing the measured first stage diagnostic with a nominal first stage diagnostic. If a deviation exceeds nominal performance then in a second stage of evaluation is triggered to identify a faulty reagent dosing device, wherein all the further reagent dosing devices are set to dose at a low quantity while simultaneously activating the first reagent dosing device to dose at two operating points, i.e. at a low dosing quantity and at medium or high dosing quantity and measuring a second stage diagnostic. The measured second stage diagnostic is compared with a nominal second stage diagnostic for determining if the first dosing device is operating correctly or faulty. In a third stage the first reagent dosing device is set to dose at a low quantity while simultaneously only one of the further reagent dosing devices is activated to dose at two operating points, i.e. at a low dosing quantity and at medium or high dosing quantity and a third stage diagnostic is measured and compared with a nominal second stage diagnostic for determining if said only one of said further reagent dosing devices is operating correctly or faulty.

18 Claims, 5 Drawing Sheets

(58) Field of Classification Search
CPC ..... F01N 2610/02; F01N 2900/1822; F01N 3/2066; Y02T 10/40; Y02T 10/12
See application file for complete search history.

(56) References Cited

U.S. PATENT DOCUMENTS

| | | | | |
|---|---|---|---|---|
| 9,458,754 | B2 * | 10/2016 | Everard | F01N 11/00 |
| 11,060,951 | B2 * | 7/2021 | Takaoka | G01M 15/09 |
| 2011/0099983 | A1 * | 5/2011 | Ohno | F01N 11/00 60/303 |
| 2011/0107742 | A1 * | 5/2011 | Igarashi | F01N 3/208 60/303 |
| 2017/0130637 | A1 | 5/2017 | Franz et al. | |

FOREIGN PATENT DOCUMENTS

| | | | | |
|---|---|---|---|---|
| DE | 102018212990 | A1 * | 2/2020 | F01N 9/00 |
| WO | 2021104733 | A1 | 6/2021 | |

* cited by examiner

EXHAUST AFTERTREATMENT SYSTEM

CROSS-REFERENCE TO RELATED APPLICATIONS

This application claims priority under 35 U.S.C. § 119 to Application NL 2038173, filed Jul. 9, 2024, which is hereby incorporated by reference in its entirety.

FIELD OF THE INVENTION

The invention relates to an exhaust aftertreatment system for an internal combustion engine.

DESCRIPTION OF RELATED ART

Such an exhaust aftertreatment system for an internal combustion engine comprising is for example known from WO2021/104733A1. The known exhaust aftertreatment system comprises a first SCR system and a second SCR system located downstream of said first SCR system. A first urea doser is adapted to inject urea reductant upstream of said first SCR system and a second urea doser is located upstream of said second SCR system and adapted to inject urea upstream of said second catalytic system. In the known exhaust aftertreatment system a first model of the first SCR system and first urea doser is provided and a second model of the second SCR system and the second urea doser is provided. After a priming period the system is switched from open loop to closed loop control with e.g. just the second SCR system and second urea doser operational, and any errors/drift in the second SCR system can be determined and characteristic parameters, e.g. the NOx conversion efficiency, in the second model can be updated. After this when switching to using just the first SCR system and first urea doser, the second SCR model is updated and an NOx sensor downstream can be used with the updated second SCR model to update the model parameters (e.g. NOx conversion efficiency) of the first model. Although the known exhaust aftertreatment system provides corrections of drifts of the individual SCR system/urea doser units the known exhaust aftertreatment system does not provide a simple manner to identify whether a specific urea doser is operating correctly or falsely.

SUMMARY OF THE INVENTION

It is an object of the invention to provide an exhaust aftertreatment system for an internal combustion engine which is able to determine whether one of the reagent dosing devices is operating correctly or is faulty.

In order to obtain this object the invention provides an exhaust aftertreatment system for an internal combustion engine according to claim 1. By arranging the reagent dosing devices in series with each other the present invention has the ability to check whether any one of the reagent dosing devices is faulty in a relatively simple manner by a multi-stage diagnostic process in which in the first stage a diagnosis of operational performance of all reagent dosing devices is performed by measuring a first stage diagnostic, which first stage diagnostic indicates whether or not an amount of reagent is dosed by all the reagent dosing devices is in conformity with a nominal amount of reagent. In case the measured first stage diagnostic indicates that the correct amount of reagent has been dosed then this is an indication that the reagent dosing devices function appropriately. In case the measured first stage diagnostic indicates that there is a deviation from the nominal amount of reagent then a faulty reagent dosing device can be identified by a next stage in which one of the reagent dosing devices is activated to dose a quantity of reagent while the other reagent dosing devices are disabled. A next stage diagnostic is then measured and compared with a nominal next stage diagnostic for determining if the one dosing device which is activated is operating correctly or is faulty. This process can be repeated by activating another one of the reagent dosing devices and disabling the other reagent dosing devices until all reagent dosing devices have been checked.

In an embodiment of an exhaust aftertreatment system for an internal combustion engine according to the invention the dosing device diagnostic circuit is configured to measure pump parameters as the first stage diagnostic in the first stage. The use of pump parameters, such as pump motor speed, pump pressure can provide a direct identification of the operational performance of a reagent dosing device.

In a further embodiment of an exhaust aftertreatment system for an internal combustion engine according to the invention the dosing device diagnostic circuit is configured to measuring pump parameters as the second and third stage diagnostic in the second and third stage. As in the first stage the use of pump parameters, such as pump motor speed, pump pressure can provide a direct identification of the operational performance of a reagent dosing device.

In a further embodiment of an exhaust aftertreatment system for an internal combustion engine according to the invention the exhaust after treatment system comprises a oxidation catalyst (OC) downstream of the first selective catalytic reduction (SCR) device, and a particulate filter (PF) downstream of the oxidation catalyst (OC) and upstream of said one or more further selective catalytic reduction (SCR) devices. In this configuration the first selective catalytic reduction (SCR) device, i.e. the upstream SCR takes advantage of the heat generated during engine warm-up which results in higher exhaust gas temperatures. This allows for faster catalyst activation and effective $NO_x$ reduction even at the early stages of engine operation.

BRIEF DESCRIPTION OF THE DRAWINGS

The invention will be further explained with reference to the Figures, in which a non-limiting exemplary embodiment of according to the invention is shown.

DETAILED DESCRIPTION

Figure 1:
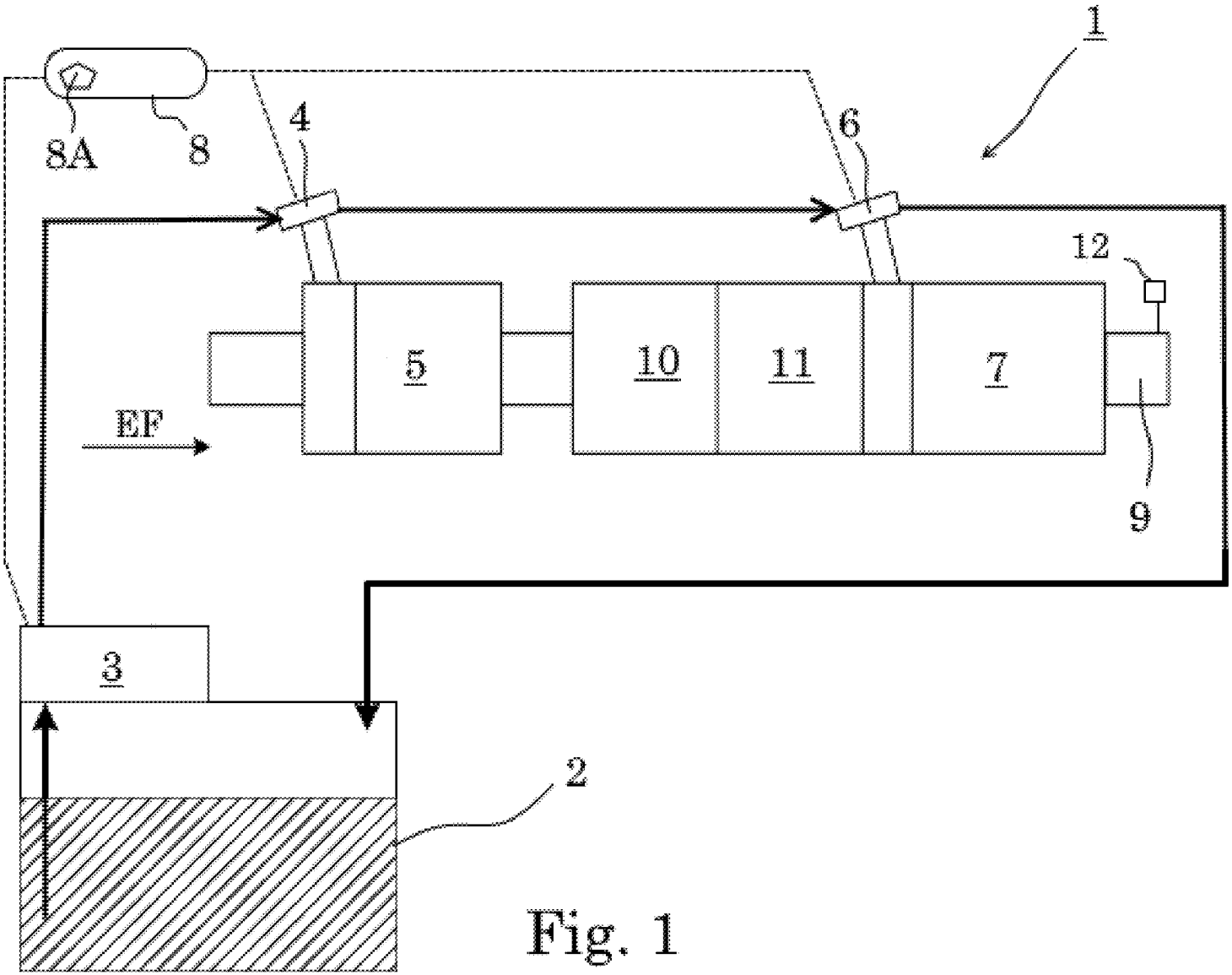
FIG. 1 schematically shows an embodiment of an exhaust aftertreatment system for an internal combustion engine according to the invention.

In FIG. 1 an embodiment of an exhaust aftertreatment system 1 for an internal combustion engine (not shown) according to the invention is shown schematically. From the internal combustion engine exhaust gases are discharged which flow in the direction of the arrow EF indicating exhaust flow. In this specification upstream and downstream is defined with regard to this exhaust flow EF.

The exhaust aftertreatment system 1 comprises a reagent storage tank 2. A pump 3 is in fluid communication with the reagent storage tank 2 and with a first reagent dosing device 4 and a further (hereinafter called second) reagent dosing device 6. The invention will be explained based on an embodiment with one first reagent dosing device and one further reagent dosing device, but the number of further reagent dosing devices can in other embodiments be more than one. The first and the second reagent dosing devices 4, 6 are arranged in series with each other, or—in general—all the reagent dosing devices are arranged in series with each other.

A first selective catalytic reduction (SCR) device 5 is arranged downstream of the first reagent dosing device 4 and the second reagent dosing device 6 is arranged downstream of the first SCR device 5. A second SCR device 7 is arranged downstream of the second reagent dosing devices 6.

In the embodiment of an exhaust aftertreatment system 1 shown in FIG. 1 the exhaust after treatment system 1 further comprises a oxidation catalyst (OC) 10 downstream of the first SCR device 5 and a particulate filter (PF) 11 downstream of the OC 10 and upstream of the second SCR device 7. A tailpipe 9 finally discharges exhaust gases from the engine.

The exhaust aftertreatment device 1 further comprises a controller 8 which is communicatively coupled to the pump 3 and the first and second reagent dosing devices 4, 6.

The controller 8 comprises a dosing device diagnostic circuit 8A which is configured to detect and identify failures or malfunctions in individual reagent dosing devices. This detection and identification is performed by in a first stage measuring operational performance of all the reagent dosing devices by measuring a first stage diagnostic, which diagnostic is indicative for the amount of reagent dosed by all the reagent dosing devices. The invention will be described hereinafter by using a pump parameter, in the discussed embodiment pump motor speed, as first stage diagnostic. Since according to the invention all reagent dosing devices are arranged in series with the (single) pump 3 pump parameters are a good indication for operational performance of all reagent dosing devices. In case the operational performance of all the reagent dosing devices measured in the first stage deviates from a nominal performance the detection and identification of failures or malfunctions in individual reagent dosing devices continues by performing next detection and identification stages in each of which stages the operational performance of one of the reagent dosing devices is analyzed. Thus the number of next detection and identification stages equals the number of reagent dosing devices. As mentioned above the invention will be discussed below with regard to the embodiment comprising two reagent dosing devices in total, i.e. the first reagent dosing device 4 and the second reagent dosing device 6, and by using pump motor speed as diagnostic.

Figure 2:
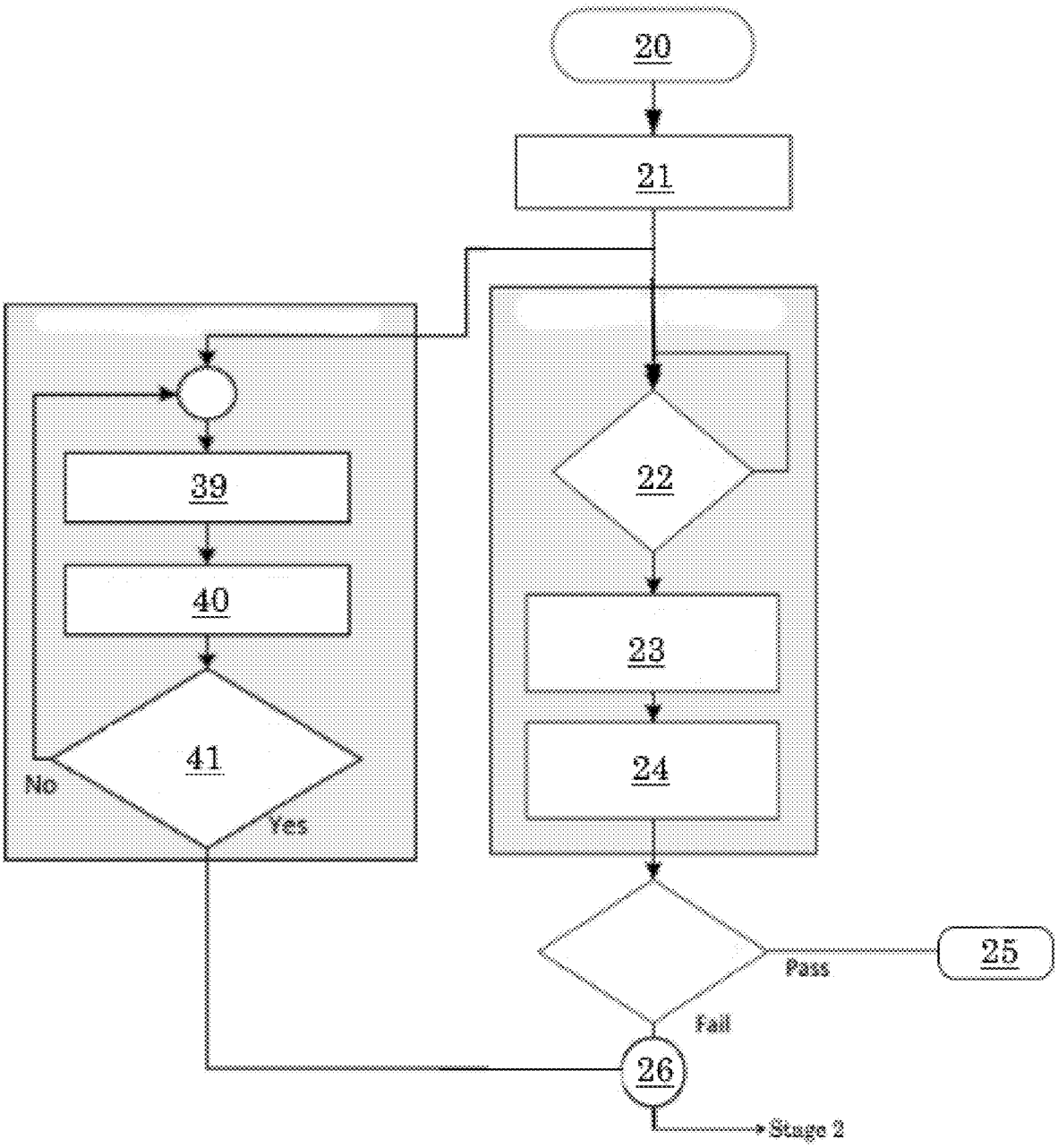
FIG. 2 shows a flow diagram of steps in a first stage executed by a dosing device diagnostic circuit of a controller of an embodiment of an exhaust aftertreatment system for an internal combustion engine according to the invention.

In FIG. 2 a flow diagram of the steps in the first stage executed by the dosing device diagnostic circuit 8A is shown to describe the first stage of detection and identification, which is started at step 20. In an initial step 21 all the reagent dosing devices 4, 6 can be primed. Then at step 22 it is checked whether or not the system is ready to measure and collect diagnostic data, in this case the pump motor speed at a certain dosing level, for reagent dosing devices operating as specified below and to create a slope line indicating performance of entire dosing system (i.e. of all dosing devices). In case the system is ready then the process continues to step 23 in which the first stage diagnostic, the pump motor speed at a certain dosing level, indicating an amount of reagent dosed by all the reagent dosing devices 4, 6 is measured. The measured first stage diagnostic is then compared with a nominal first stage diagnostic in step 24 (as discussed below with regard to FIG. 4), and when the measured first stage diagnostic is in conformity with the nominal first stage diagnostic, meaning that the reagent dosing devices as a whole passes the performance test, then the process ends in 25. In case a deviation from nominal is detected, meaning that the reagent dosing devices as a whole fail the performance test, the detection and identification of failures or malfunctions in individual reagent dosing devices continues to stage 2 and further as indicated by step 26.

Figure 3:
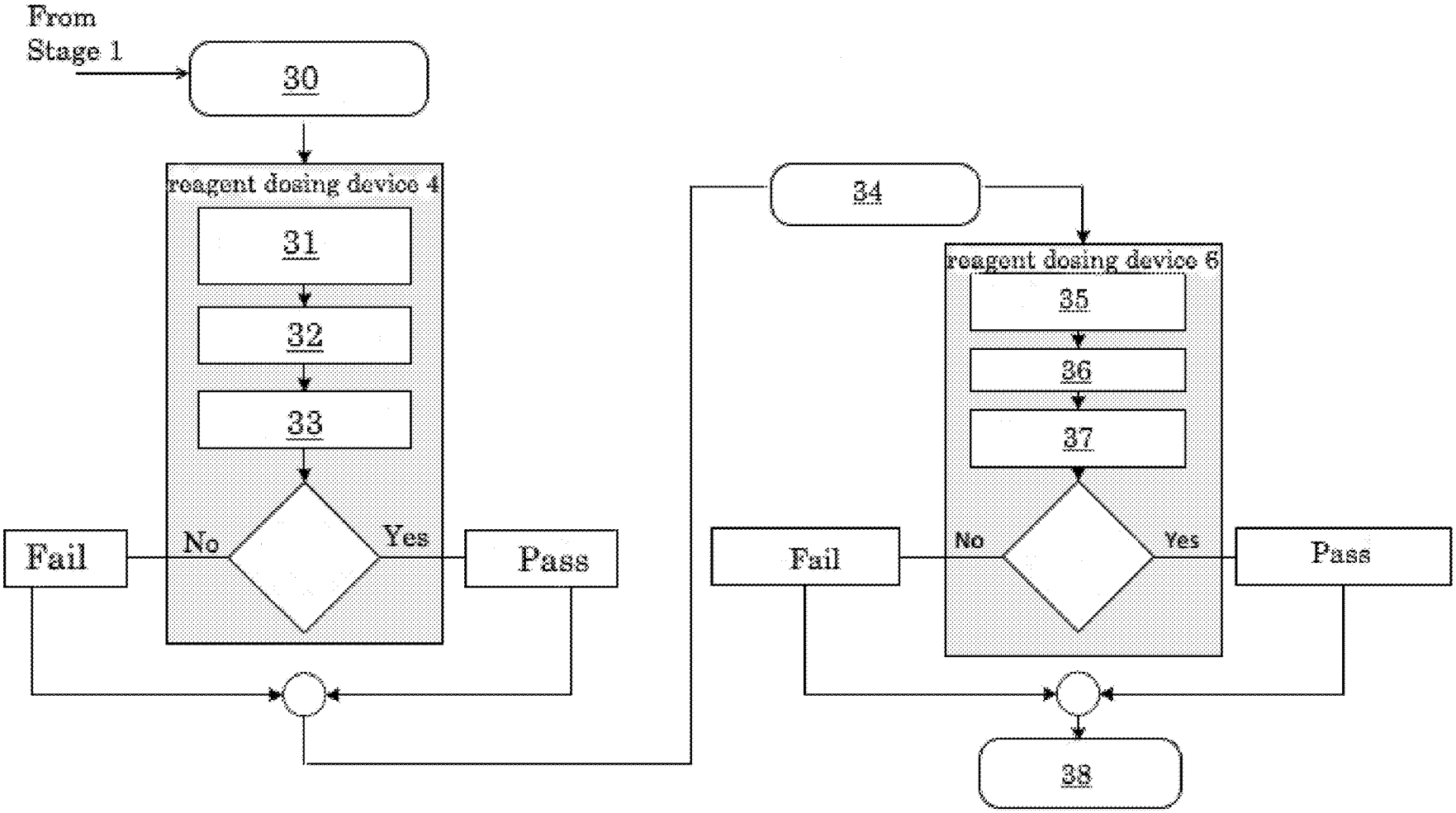
FIG. 3 shows a flow diagram of steps in a second and third stage executed by a dosing device diagnostic circuit of a controller of an embodiment of an exhaust aftertreatment system for an internal combustion engine according to the invention.

In FIG. 3 a flow diagram of the steps in the second and third stage executed by the dosing device diagnostic circuit 8A is shown to describe the next stages of detection and identification of a faulty reagent dosing device. Step 30 starts for analyzing the performance of the first reagent dosing device 4 by in step 31 disabling the second reagent dosing device 6 or setting the second reagent dosing device 6 to dose at a quantity of less than 10% of maximum dosing quantity while simultaneously activating the first reagent dosing device 4 to dose at two operating points, that is at a low dosing quantity (less than 10% of the maximum dosing quantity) and at medium or high dosing quantity (i.e. between 60 to 100% of maximum dosing quantity). In Step 32 data (i.e. pump motor speed) is collected during these operating points and in step 33 the measured data (i.e. second stage diagnostic) is compared with a nominal second stage diagnostic (discussed below with regard to FIG. 5) for determining if the first dosing device 4 is operating correctly or is faulty. The dosing device diagnostic circuit 8A is configured to thereafter continue the process to the third stage step 34 for analyzing the performance of the second reagent dosing device 6 by in step 35 disabling the first reagent dosing device 4 or setting the first reagent dosing device 4 to dose at a quantity of less than 10% of maximum dosing quantity while simultaneously activating the second reagent dosing device 6 to dose at two operating points, that is at a low dosing quantity (less than 10% of the maximum dosing quantity) and at medium or high dosing quantity (i.e. between 60 to 100% of maximum dosing quantity). In Step 36 data (i.e. pump motor speed) is collected during these operating points and in step 37 the measured data (i.e. third stage diagnostic is compared with a nominal third stage diagnostic (discussed below with regard to FIG. 6) for determining if the second dosing device 6 is operating correctly or is faulty. Thereafter the dosing device diagnostic circuit 8A is configured to end the process in step 38.

Figure 4:
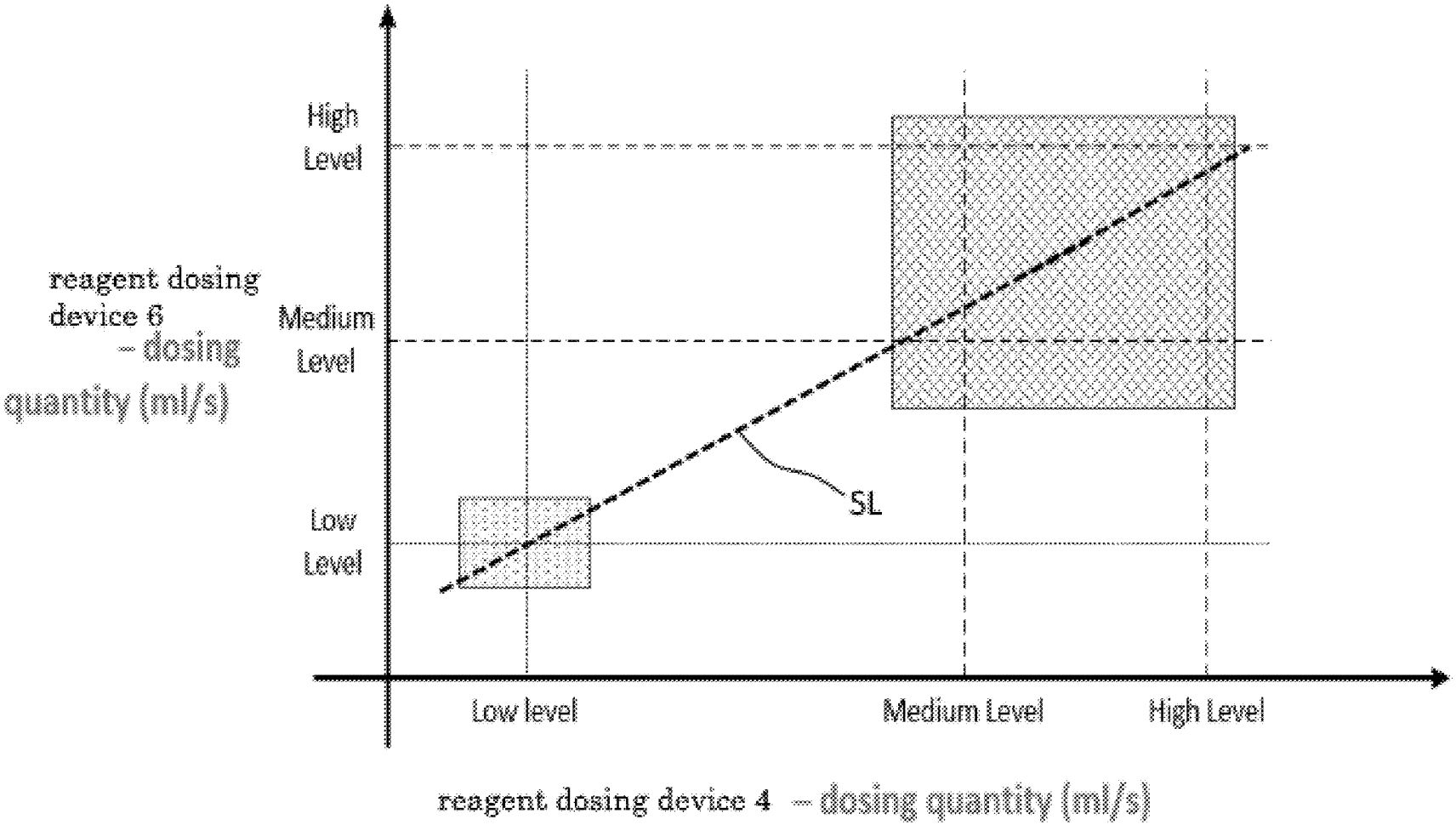
FIG. 4 shows a diagram indicating reagent dosing quantity based enable windows for first stage diagnostic evaluation to be carried out.

In FIG. 4 a diagram is shown indicating dosing quantity based enable window for diagnostic evaluation of the two reagent dosing devices 4, 6 together. Pump motor speed data is measured as first stage diagnostic in which both reagent dosing devices are dosing at an operating point in which dosing is effected at a low quantity or in which both reagent dosing devices are disabled. Next, pump motor speed data is measured when both reagent dosing devices 4, 6 are dosing at another operating point in which dosing is effected at a medium to high or maximum quantity (i.e. at a quantity between 60% and 100% of maximum dosing quantity). A slope of pump motor speed can be created between low level dosing and medium to high level dosing to characterize operational performance of the two reagent dosing devices together. When the slope deviates from nominal (a slope SL created between the squares indicated in the diagram) this is an indication that at least one of the reagent dosing devices is operating incorrectly. Thus by analyzing the relationship between pump motor speed at low dosing commands and medium to high dosing commands, deviations from a nominal system can be identified. A correctly functioning system of all reagent dosing devices will have a different slope compared to a system with underdosing or overdosing dosing devices.

Figure 5:
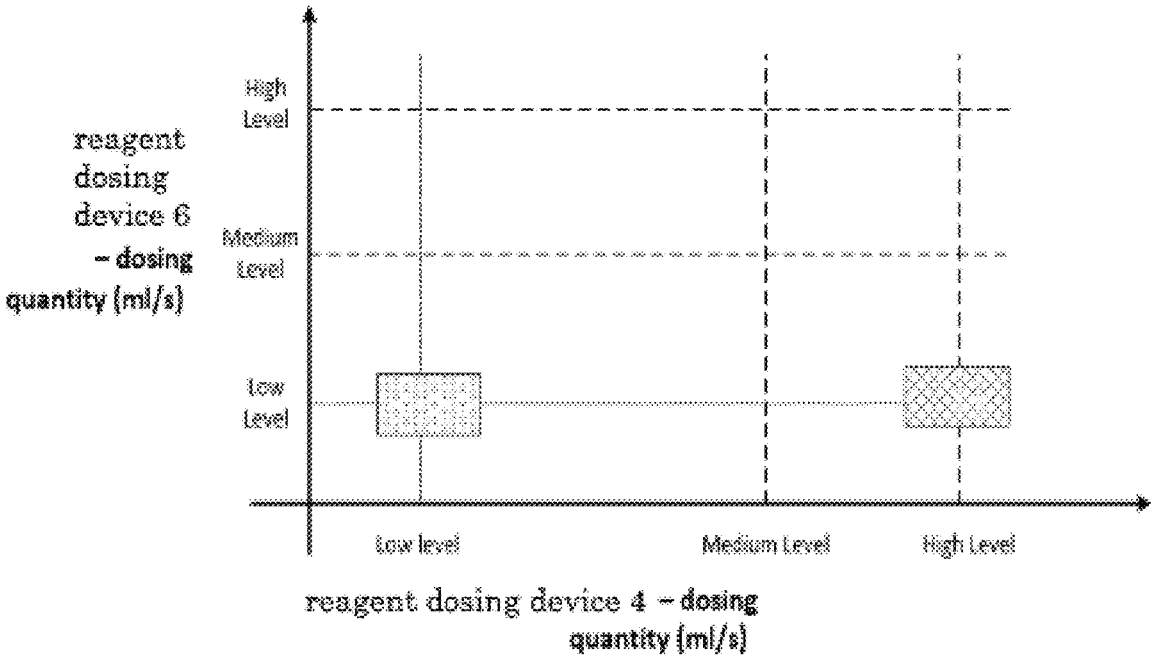
FIG. 5 shows a diagram indicating reagent dosing quantity based enable windows for second stage diagnostic evaluation for reagent dosing device 4.

In FIG. 5 shows a diagram indicating reagent dosing quantity based enable windows for second stage diagnostic evaluation for reagent dosing device 4. The second reagent dosing device 6 is disabled or set to dose a low quantity amount of reagent, while the first reagent dosing device 4 is set to dose at two operating points, that is at a low dosing quantity (less than 10% of the maximum dosing quantity) and at medium or high dosing quantity (i.e. between 60 to 100% of maximum dosing quantity) as described above with reference to FIG. 3. In each operating point dosing is preferably effected during a period of 5 to 15 seconds. Pump motor speed data is measured and the operational performance of the first reagent dosing device 4 is evaluated based on pump motor speed. A slope of pump motor speed can be created between the different dosing levels to characterize operational performance of the first reagent dosing device 4. When the slope deviates from nominal (a slope created between the squares indicated in the diagram) this is an indication that the reagent dosing device 4 is operating incorrectly.

Figure 6:
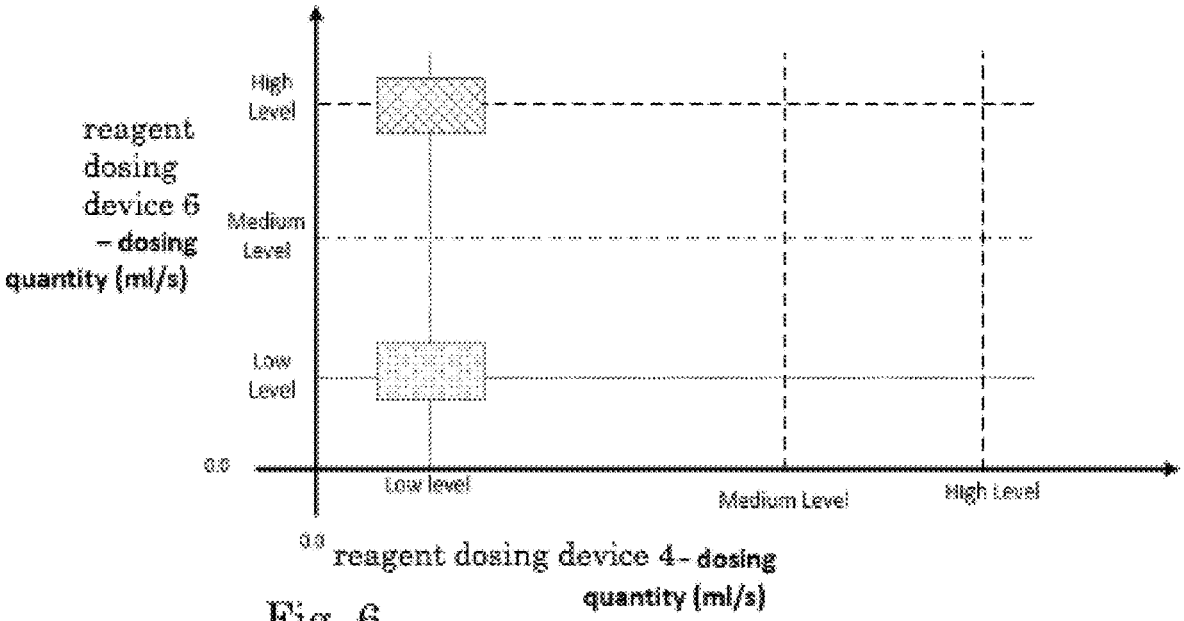
FIG. 6 shows a diagram indicating reagent dosing quantity based enable windows for third stage diagnostic evaluation for reagent dosing device 6.

In FIG. 6 shows a diagram indicating reagent dosing quantity based enable windows for third stage diagnostic evaluation for reagent dosing device 6. The first reagent dosing device 4 is disabled or set to dose a low quantity amount of reagent, while the second reagent dosing device 6 is set to dose at two operating points, that is at a low dosing quantity (less than 10% of the maximum dosing quantity) and at medium or high dosing quantity (i.e. between 60 to 100% of maximum dosing quantity) as described above with reference to FIG. 3. In each operating point dosing is preferably effected during a period of 5 to 15 seconds. Pump motor speed data is measured and the operational performance of the second reagent dosing device 6 is evaluated based on pump motor speed. A slope of pump motor speed can be created between the different dosing levels to characterize operational performance of the second reagent dosing device 6. When the slope deviates from nominal (a slope created between the squares indicated in the diagram) this is an indication that the reagent dosing device 6 is operating incorrectly.

With reference to FIG. 2 it is observed that the second and third stage diagnostic evaluation can also be triggered by measurements of the NOx tailpipe emission exceedance by means of an NOx sensor 12. In step 39 the NOx emission is measured and in step 40 the measured NOx emission is compared with an NOx threshold and in step 41 it is evaluated over a time window whether or not the measured NOx emission exceeds the NOx threshold. In case the measured NOx emission exceeds the NOx threshold then the second and third stage diagnostic evaluation are triggered, if not then the process returns to a new NOx measurement. It is also observed that independent of the first stage diagnostic evaluation the second and third stage diagnostic evaluation can also be triggered, e.g. every 10,000 km of vehicle run, as a periodic health check of the reagent dosing devices.

The invention claimed is:

1. An exhaust aftertreatment system for an internal combustion engine comprising:

a reagent storage tank;

a pump in fluid communication with the reagent storage tank;

a first reagent dosing device in fluid communication with the pump;

a first selective catalytic reduction (SCR) device arranged downstream of the first reagent dosing device;

one or more further reagent dosing devices arranged downstream of the first selective catalytic reduction (SCR) device, said one or more further reagent dosing devices being in fluid communication with said pump; and one or more further selective catalytic reduction (SCR) devices arranged downstream of a respective one of said one or more reagent dosing devices; and a controller communicatively coupled to the pump and the first and said one or more further reagent dosing devices wherein said one or more further reagent dosing devices is/are arranged in series with the first reagent dosing device, and wherein the controller comprises a dosing device diagnostic circuit configured to in a first stage performing a diagnosis of operational performance of all reagent dosing devices by executing the steps of a) measuring pump motor speed while all reagent dosing devices dose at two operating points, computing a first stage diagnostic, and evaluating the first stage diagnostic;

b) comparing the evaluated first stage diagnostic with a nominal first stage diagnostic;

c) in case a deviation is determined in step b) the dosing device diagnostic circuit further configured to identify a faulty reagent dosing device by executing in a second stage the steps of d) disabling all further reagent dosing devices or setting all further reagent dosing devices to dose at a low quantity of less than 10% of a maximum dosing amount while simultaneously activating the first reagent dosing device to dose at the two operating points, and evaluating a second stage diagnostic;

e) comparing the evaluated second stage diagnostic with a nominal second stage diagnostic for determining if the first dosing device is operating correctly or is faulty; and in a third stage executing the steps of f) disabling the first reagent dosing device or setting the first reagent dosing device to dose at a low quantity of less than 10% of the maximum dosing amount while simultaneously activating only one of said one or more further reagent dosing devices to dose at the two operating points, and evaluating a third stage diagnostic; and g) comparing the evaluated third stage diagnostic with a nominal second stage diagnostic for determining if said only one of said one or more further reagent dosing devices is operating correctly or is faulty.

2. The exhaust aftertreatment system for an internal combustion engine according to claim 1, wherein the dosing device diagnostic circuit is configured to in the first stage measuring pump parameters as the first stage diagnostic.

3. The exhaust aftertreatment system for an internal combustion engine according to claim 1, wherein the dosing device diagnostic circuit is configured to measure pump parameters as the second and third stage diagnostic in the second and third stage.

4. The exhaust aftertreatment system for an internal combustion engine according to claim 1, wherein the exhaust after treatment system comprises an oxidation catalyst (OC) downstream of the first selective catalytic reduction (SCR) device, and a particulate filter (PF) downstream of the oxidation catalyst (OC) and upstream of said one or more further selective catalytic reduction (SCR) devices.

5. The exhaust aftertreatment system for an internal combustion engine according to claim 1, wherein the exhaust after treatment system comprises a tailpipe for discharging exhaust gases from the engine and an $NO_x$ sensor for measuring tailpipe $NO_x$ emission, wherein the dosing device diagnostic circuit is configured to measure NOx emission by means of the NOx sensor, comparing the measured NOx emission with an NOx threshold and evaluating over a time window whether or not the measured NOx emission exceeds the NOx threshold; and triggering the second and third stage diagnostic evaluation in case the measured NOx emission exceeds the NOx threshold and returning to a new NOx measurement in case the measured NOx emission does not exceed the NOx threshold.

6. The exhaust aftertreatment system of claim 1, wherein a first of the two operating points is at a low dosing quantity and a second of the two operating points is at a medium or high dosing quantity.

7. The exhaust aftertreatment system of claim 6, wherein the low dosing quantity is less than 10% of the maximum dosing quantity, and the medium or high dosing quantity is between 60% and 100% of the maximum dosing quantity.

8. The exhaust aftertreatment system of claim 1, wherein the first stage diagnostic is an operational performance slope for all reagent dosing devices.

9. The exhaust aftertreatment system of claim 8, wherein the operational performance slope is based on pump motor speed and injected dose quantity.

10. The exhaust aftertreatment system for an internal combustion engine according to claim 2, wherein the dosing device diagnostic circuit is configured to measure pump parameters as the second and third stage diagnostic in the second and third stage.

11. The exhaust aftertreatment system for an internal combustion engine according to claim 4, wherein the dosing device diagnostic circuit is configured to measure pump parameters as the second and third stage diagnostic in the second and third stage.

12. The exhaust aftertreatment system for an internal combustion engine according to claim 5, wherein the dosing device diagnostic circuit is configured to measure pump parameters as the second and third stage diagnostic in the second and third stage.

13. The exhaust aftertreatment system for an internal combustion engine according to claim 2, wherein the exhaust after treatment system comprises an oxidation catalyst (OC) downstream of the first selective catalytic reduction (SCR) device, and a particulate filter (PF) downstream of the oxidation catalyst (OC) and upstream of said one or more further selective catalytic reduction (SCR) devices.

14. The exhaust aftertreatment system for an internal combustion engine according to claim 3, wherein the exhaust after treatment system comprises an oxidation catalyst (OC) downstream of the first selective catalytic reduction (SCR) device, and a particulate filter (PF) downstream of the oxidation catalyst (OC) and upstream of said one or more further selective catalytic reduction (SCR) devices.

15. The exhaust aftertreatment system for an internal combustion engine according to claim 5, wherein the exhaust after treatment system comprises an oxidation catalyst (OC) downstream of the first selective catalytic reduction (SCR) device, and a particulate filter (PF) downstream of the oxidation catalyst (OC) and upstream of said one or more further selective catalytic reduction (SCR) devices.

16. The exhaust aftertreatment system for an internal combustion engine according to claim 2, wherein the exhaust after treatment system comprises a tailpipe for discharging exhaust gases from the engine and an $NO_x$ sensor for measuring tailpipe $NO_x$ emission, wherein the dosing device diagnostic circuit is configured to measure NOx emission by means of the NOx sensor, comparing the measured NOx emission with an NOx threshold and evaluating over a time window whether or not the measured NOx emission exceeds the NOx threshold; and triggering the second and third stage diagnostic evaluation in case the measured NOx emission exceeds the NOx threshold and returning to a new NOx measurement in case the measured NOx emission does not exceed the NOx threshold.

17. The exhaust aftertreatment system for an internal combustion engine according to claim 3, wherein the exhaust after treatment system comprises a tailpipe for discharging exhaust gases from the engine and an NOx sensor for measuring tailpipe $NO_x$ emission, wherein the dosing device diagnostic circuit is configured to measure NOx emission by means of the NOx sensor, comparing the measured NOx emission with an NOx threshold and evaluating over a time window whether or not the measured NOx emission exceeds the NOx threshold; and triggering the second and third stage diagnostic evaluation in case the measured NOx emission exceeds the NOx threshold and returning to a new NOx measurement in case the measured NOx emission does not exceed the NOx threshold.

18. The exhaust aftertreatment system for an internal combustion engine according to claim 4, wherein the exhaust after treatment system comprises a tailpipe for discharging exhaust gases from the engine and an NOx sensor for measuring tailpipe $NO_x$ emission, wherein the dosing device diagnostic circuit is configured to measure NOx emission by means of the NOx sensor, comparing the measured NOx emission with an NOx threshold and evaluating over a time window whether or not the measured NOx emission exceeds the NOx threshold; and triggering the second and third stage diagnostic evaluation in case the measured NOx emission exceeds the NOx threshold and returning to a new NOx measurement in case the measured NOx emission does not exceed the NOx threshold.

* * * * *